US008136170B2

(12) United States Patent
DiPaola

(10) Patent No.: US 8,136,170 B2
(45) Date of Patent: Mar. 20, 2012

(54) POWERED HELMET WITH VISOR DEFOGGING ELEMENT AND ACCESSORIES

(75) Inventor: Dean DiPaola, Morrison, CO (US)

(73) Assignee: Dean DiPaola, Morrison, CO (US)

( * ) Notice: Subject to any disclaimer, the term of this patent is extended or adjusted under 35 U.S.C. 154(b) by 572 days.

(21) Appl. No.: 12/350,777

(22) Filed: Jan. 8, 2009

(65) Prior Publication Data

US 2009/0235438 A1 Sep. 24, 2009

Related U.S. Application Data

(60) Provisional application No. 61/026,258, filed on Feb. 5, 2008.

(51) Int. Cl.
*A61F 9/02* (2006.01)

(52) U.S. Cl. ..... 2/435

(58) Field of Classification Search ..... 2/435; 381/376; 455/41.2

See application file for complete search history.

(56) References Cited

U.S. PATENT DOCUMENTS 3,027,561 A 4/1962 Senne
3,881,198 A * 5/1975 Waters ..... 2/171.3
4,498,202 A * 2/1985 Yamamoto ..... 2/424
4,584,721 A 4/1986 Yamamoto
4,612,675 A * 9/1986 Broersma ..... 2/424
4,633,532 A * 1/1987 Yagasaki ..... 2/424
4,638,728 A 1/1987 Elenewski
4,682,007 A 7/1987 Hollander
4,729,132 A * 3/1988 Fierro ..... 2/414
4,863,244 A * 9/1989 Fuerthbauer et al. ..... 349/14
4,893,356 A * 1/1990 Waters ..... 2/171.3
4,901,210 A * 2/1990 Hanabusa ..... 362/106
4,944,044 A * 7/1990 Zarotti ..... 2/413
5,031,237 A * 7/1991 Honrud ..... 2/8.6
5,327,587 A 7/1994 Hurwitz
5,500,953 A * 3/1996 Reuber et al. ..... 2/9
5,561,855 A * 10/1996 McFall ..... 2/8.6
5,570,946 A * 11/1996 Chien ..... 362/84
5,671,483 A * 9/1997 Reuber ..... 2/424
5,683,831 A * 11/1997 Baril et al. ..... 429/96
5,694,650 A 12/1997 Hong
5,765,235 A * 6/1998 Arnold ..... 2/424
5,822,126 A * 10/1998 Cursolle et al. ..... 359/630
5,896,579 A * 4/1999 Johnson et al. ..... 2/8.6
6,481,019 B2 * 11/2002 Diaz et al. ..... 2/171.3
6,701,537 B1 3/2004 Stamp
6,859,946 B2 * 3/2005 Fournier et al. ..... 2/424
7,080,414 B1 * 7/2006 Montero et al. ..... 2/424
7,303,302 B2 * 12/2007 Harris ..... 362/105
2003/0209241 A1 * 11/2003 Fournier et al. ..... 128/201.22
2004/0052068 A1 * 3/2004 Chien et al. ..... 362/105
2004/0237178 A1 * 12/2004 Landeros ..... 2/457
2005/0071909 A1 * 4/2005 Diaz et al. ..... 2/171.3
2005/0167590 A1 * 8/2005 Miyano et al. ..... 250/330
2007/0000031 A1 * 1/2007 Makris et al. ..... 2/411

* cited by examiner

*Primary Examiner* — Brian D Nash
(74) *Attorney, Agent, or Firm* — Kilpatrick Townsend & Stockton LLP

(57) ABSTRACT

According to the invention, a helmet with a defogging visor is disclosed. The helmet may include a shell, a visor, a defogging element, and a power source. The shell may define at least a first opening. The visor may be coupled with the shell and may be at least partially disposed over the first opening. The defogging element may be configured to defog the visor. The power source may be directly coupled with the shell and may be operably coupled with the defogging element.

23 Claims, 7 Drawing Sheets

POWER SOURCE (COULD BE ANY SHAPE OR SIZE) STRAPPED TO THE CHEST OR BACK, CREATING A CORDLESS ENVIRONMENT FOR THE PERSON/HELMET

HEATING ELEMENT DESIGN #1

HEATING ELEMENT DESIGN #2

#3 ETC.

THE POWER SOURCE IS CAPABLE OF POWERING ANY HEATING ELEMENT DESIGN

POWER SOURCE LOCATED IN THE REAR OF THE HELMET (MAY BE INSIDE OR OUTSIDE OF HELMET)

POWER SOURCE LOCATED IN THE REAR BELOW THE BACK OF THE HELMET

POWER SOURCE LOCATED ON THE TOP OF THE HELMET (MAY BE INSIDE OR OUTSIDE OF HELMET)

POWER SOURCE LOCATED ON THE SIDE (LEFT, RIGHT, OR BOTH) OF THE HELMET (MAY BE INSIDE OR OUTSIDE OF HELMET)

POWER SOURCE (COULD BE ANY SHAPE OR SIZE) STRAPPED TO THE CHEST OR BACK, CREATING A CORDLESS ENVIRONMENT FOR THE PERSON/HELMET

POWER SOURCE MAY BE CARRIED IN A POCKET OF CLOTHING, CREATING A CORDLESS ENVIRONMENT FOR THE PERSON/HELMET

POWERED HELMET WITH VISOR DEFOGGING ELEMENT AND ACCESSORIES

CROSS-REFERENCE TO RELATED APPLICATIONS

This application claims priority to Provisional U.S. Patent Application No. 61/026,258 filed Feb. 5, 2008, entitled "HELMET WITH VISOR DEFOGGING ELEMENT," the entire disclosure of which is hereby incorporated by reference, for all purposes, as if fully set forth herein.

BACKGROUND OF THE INVENTION

This invention relates generally to powered headgear. More specifically the invention relates to helmets with defogging elements which are powered by local power supplies.

Visors on helmets used in various climates and weather circumstances may often fog up during use. This can cause problems for the wearer ranging from inconvenience to outright physical hazard if the wearer is engaged in an activity where visual awareness is critical.

Defoggers on the visors, which typically require power to operate, have been employed, but require sufficient power to be effective. This often entails physically connecting the helmet with a source remote from the helmet. Such a physical tether to a remote source may be inconvenient or unsafe for the user. Additionally, for any other electrical device employed by the user, either an additional power source or tether must also be employed for that other device.

Embodiments of the invention provide solutions to these and other problems.

BRIEF SUMMARY OF THE INVENTION

In one embodiment of the invention, a helmet with a defogging visor is provided. The helmet may include a shell, a visor, a defogging element, and a power source. The shell may define at least a first opening. The visor may be coupled with the shell and may be at least partially disposed over the first opening. The defogging element may be configured to defog the visor. The power source may be directly coupled with the shell and may be operably coupled with the defogging element.

In another embodiment of the invention, another helmet with a defogging visor is provided. The helmet may include a shell, a visor, a defogging element, and a power source, as in the other embodiment described above. However, in this embodiment, the power source may be directly supported by a user of the helmet and may be operably coupled with the defogging element.

Embodiments of the invention may allow a user of the helmet to be free of couplings with external power sources separate from the user and/or the helmet. This may be advantageous with regard to certain activities usually performed by a person while wearing a helmet. Merely by way of example, skiing, snowboard, bicycling, and/or other exercise/sporting/recreational activities, as well as operation of motorcycles, automobiles, snowmobiles, watercraft and/or industrial equipment may benefit from a user being able to move independently with the helmet, free from couplings to external power sources.

BRIEF DESCRIPTION OF THE DRAWINGS

The present invention is described in conjunction with the appended figures.

Figure 1A:
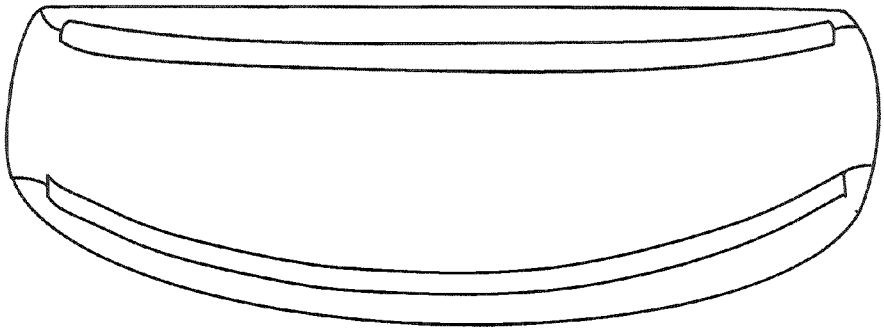
FIG. 1*a* is a heating element design of one embodiment of the invention.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, processes, and other elements in the invention may be shown as components in block diagram form in order not to obscure the embodiments in unnecessary detail. In other instances, well-known circuits, processes, structures, and techniques may be shown without unnecessary detail in order to avoid obscuring the embodiments.

In one embodiment of the invention, a helmet with a defogging visor is provided. The helmet may include a shell, a visor, a defogging element, and a power source. The shell may define at least a first opening. The visor may be directly coupled with the shell and may be at least partially disposed over the first opening. The defogging element may be configured to defog the visor. The power source may be coupled with the shell and may be operably coupled with the defogging element.

In another embodiment of the invention, another helmet with a defogging visor is provided. The helmet may include a shell, a visor, a defogging element, and a power source, as in the other embodiment described above. However, in this embodiment, the power source may be directly supported by a user of the helmet and may be operably coupled with the defogging element.

The shell may be fabricated from any number of materials including, but not limited to, plastics, polymers, composites, and metals. The shell may have an opening for a user of the helmet to insert their head, as well as an opening to allow the user to see outward from the helmet. Merely by way of example, the shell may be a one-quarter, one-half, three-quarters, or full coverage helmet. Other openings in the shell may also be present to allow for air flow around different portions of the user's head. The shell may also include padding and other mechanisms such as straps to allow for correct fitting, stabilization, and retaining of the helmet on the user's head. Padding, straps, and/or other mechanisms may be removable to access other components of the helmet. For example, padding may be detachably coupled via Velcro® fasteners to allow for access to an interior portion of the shell, possibly where the interior portion houses the power source or other components.

The visor may be fabricated from any number of materials including, but not limited to, plastics, polymers, composites, and/or any other material that will allow for a desirable level of visibility. The visor may also be shaded, tinted, mirrored, or colored (yellow, rose, etc.) in some fashion. In some embodiments, the visor may be rotatably coupled with the shell. In these or other embodiments, the visor may be permanently or detachably coupled with the shell. Detachably coupled visors may allow for easy cleaning and/or maintenance.

The defogging element may, for example, be any device known in the art and suitable to defog the visor. In some embodiments, the defogging element may include one or more heating elements of any possible specific type or configuration configured to heat the visor. In these or other embodiments, the defogging element may also include a micro-convection device configured to move air over the visor. In some embodiments, multiple devices or apparatuses may make up the defogging element.

Figure 1B:
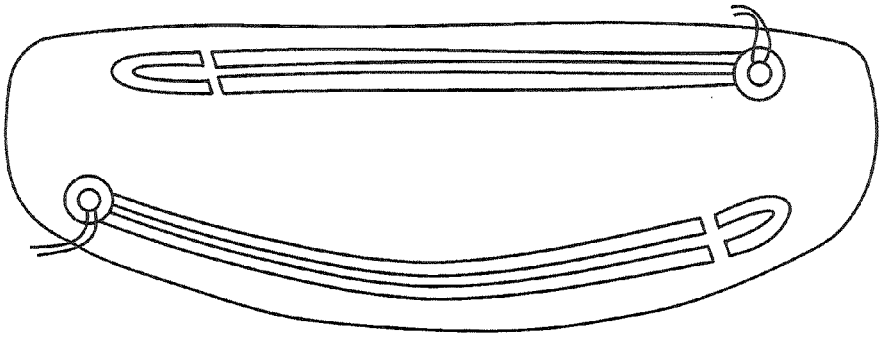
FIG. 1*b* is another heating element design of a different embodiment of the invention.

In some embodiments, the defogging element may be at least partially coupled with the visor. In other embodiments, the defogging element may be at least partially coupled with the shell. In yet other embodiments, the defogging element may be partially coupled with multiple other components. In some embodiments, the defogging element may be permanently or detachably coupled with whichever other component it is coupled with. Detachably coupled defogging elements may allow for easy cleaning and/or maintenance. Two possible examples of heating element defogging elements are shown in FIG. 1*a* and FIG. 1*b*, though any number of other heating element types and configurations are also possible.

The power source, when coupled with the shell, may be permanently or detachably coupled with the shell. In some embodiments, the power source may include a rechargeable battery. In other embodiments, particularly in embodiments where the power source is detachably coupled with the shell, the power source may include a disposable battery. In these or other embodiments, the power source may include additional systems such as solar power devices and/or kinetic energy harnessing devices.

In some embodiments, particularly in embodiments where the power source is a rechargeable battery, the helmet may also include a coupling point, where the coupled point is configured to detachably and operably couple a recharging device with the power source. One example of such an embodiment would be where a rechargeable battery was integrated with the shell such that it was not removable. In such an embodiment, the helmet might be plugged in to a recharging device to recharge the battery. In these or other embodiments, any recharging circuitry may be located in the helmet or in a separate device.

In some embodiments, particularly in embodiments where the power source is detachably coupled with the shell, the power source may include a coupling point, where the coupling point is configured to detachably and operably couple a recharging device with the power source. In some embodiments, particularly in embodiments where the power source is detachably coupled with the shell, the helmet may include a coupling point, where the coupling point is configured to detachably and operably couple the power source device with the defogging element.

In various embodiments, the power source may be coupled with the shell in various locations. Coupling may occur by any number of mechanisms, including Velcro®, or other mechanical means where interference fits are employed with mechanical levers to release the power source. In other embodiments, the power source may be located any possible position. In exemplary embodiments, the power source will be coupled with the shell and/or supported by the user.

Figure 2A:
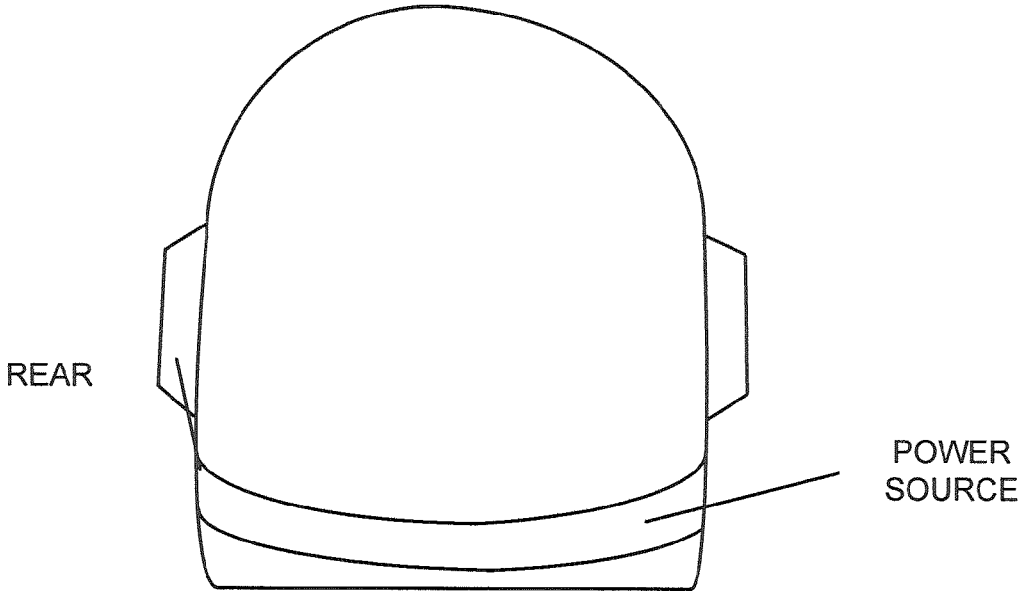
FIG. 2*a* is a rear view of a helmet of the invention with a power source located in the rear of the helmet's shell.
Figure 2B:
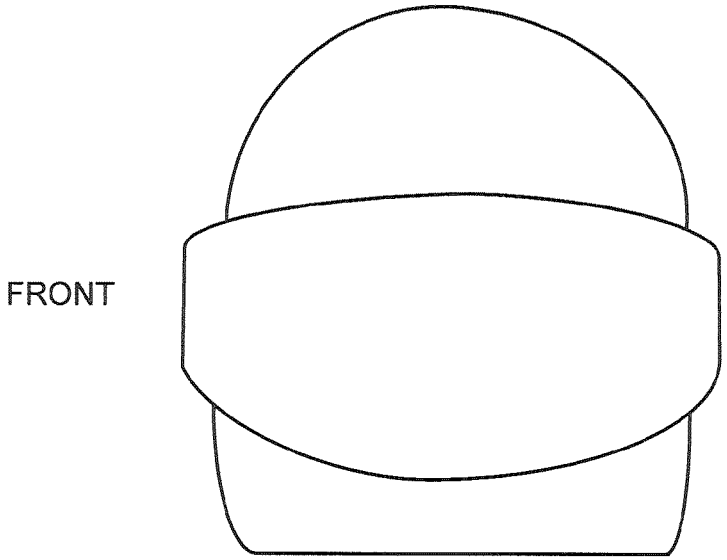
FIG. 2*b* is front view of the helmet of FIG. 2*a;*
Figure 3A:
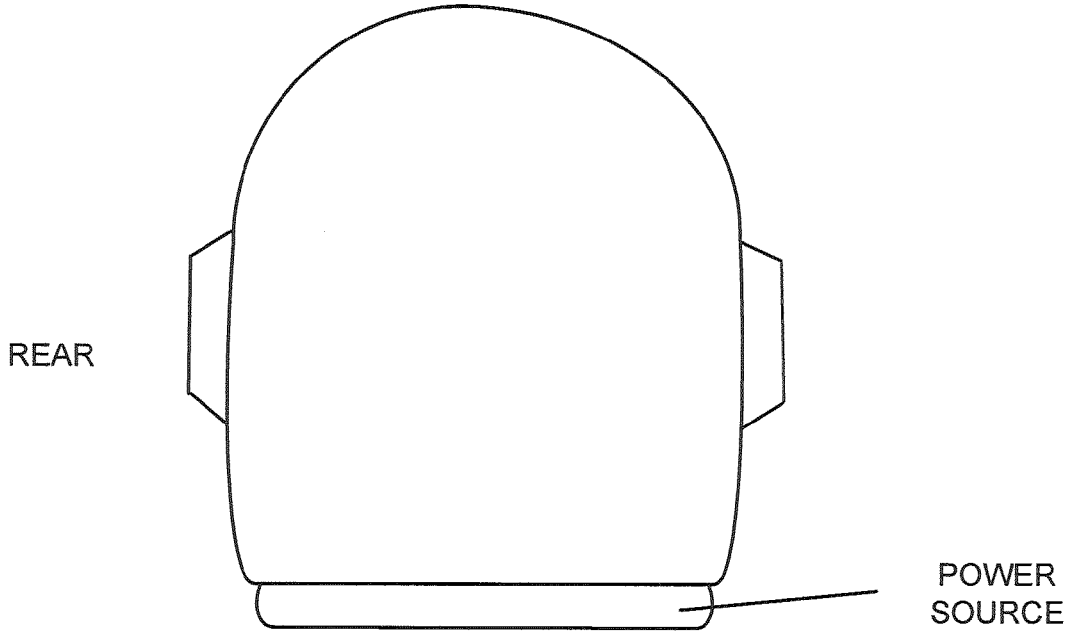
FIG. 3*a* is a rear view of a helmet of the invention with a power source located in the bottom rear of the helmet's shell.
Figure 3B:
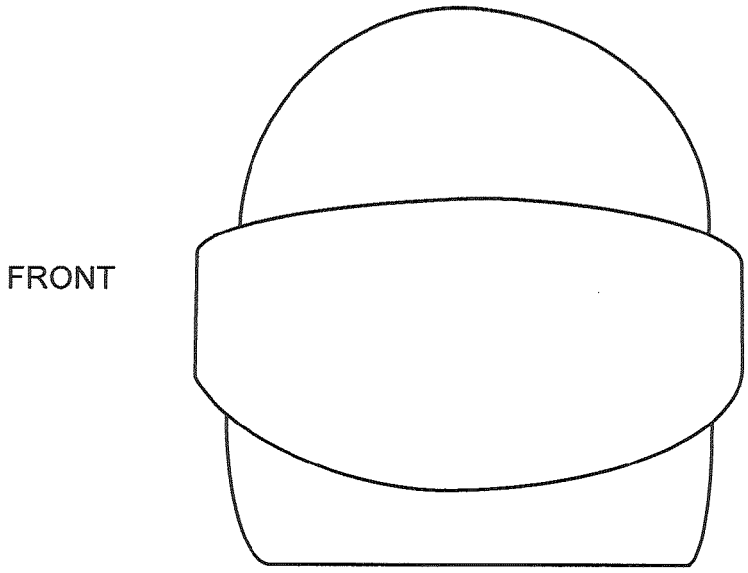
FIG. 3*b* is front view of the helmet of FIG. 3*a;*

In one embodiment, the power source may be coupled with a rear of the shell, either on the inside of the shell or on the outside of the shell. An example of this sort of embodiment is shown in FIG. 2*a* and FIG. 2*b*. In another embodiment, the power source may be coupled with a bottom of a rear of the shell, either on the inside of the shell or on the outside of the shell. An example of this sort of embodiment is shown in FIG. 3*a* and FIG. 3*b*.

Figure 4A:
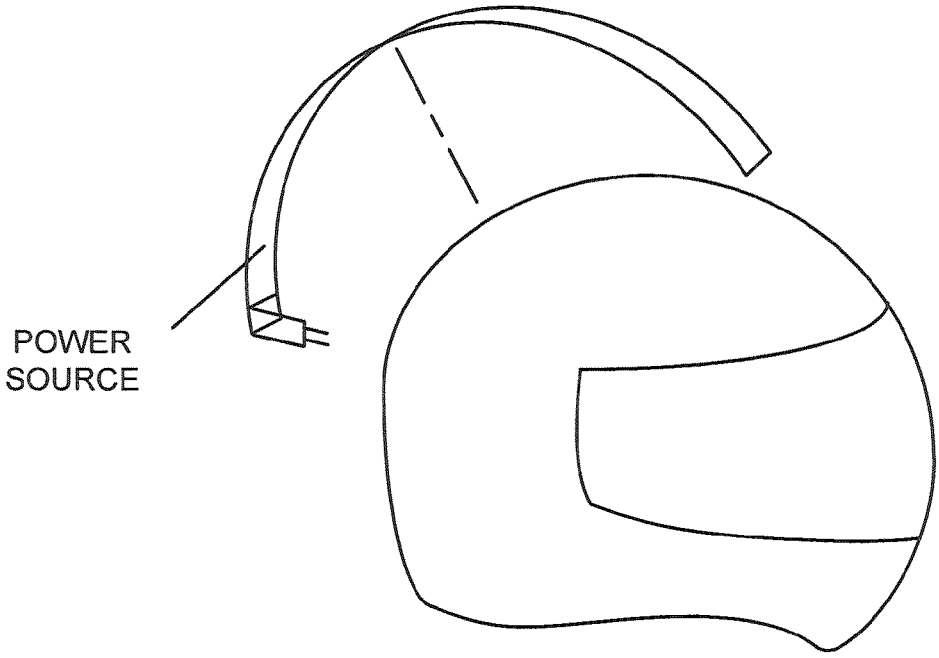
FIG. 4*a* is a perspective view of a helmet of the invention with a power source located along a top radian of the helmet's shell.
Figure 4B:
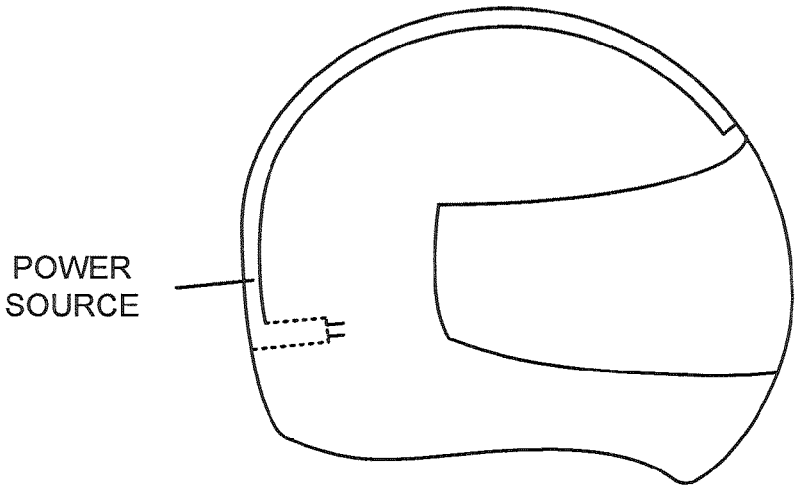
FIG. 4*b* is side view of the helmet of FIG. 4*a;*
Figure 5A:
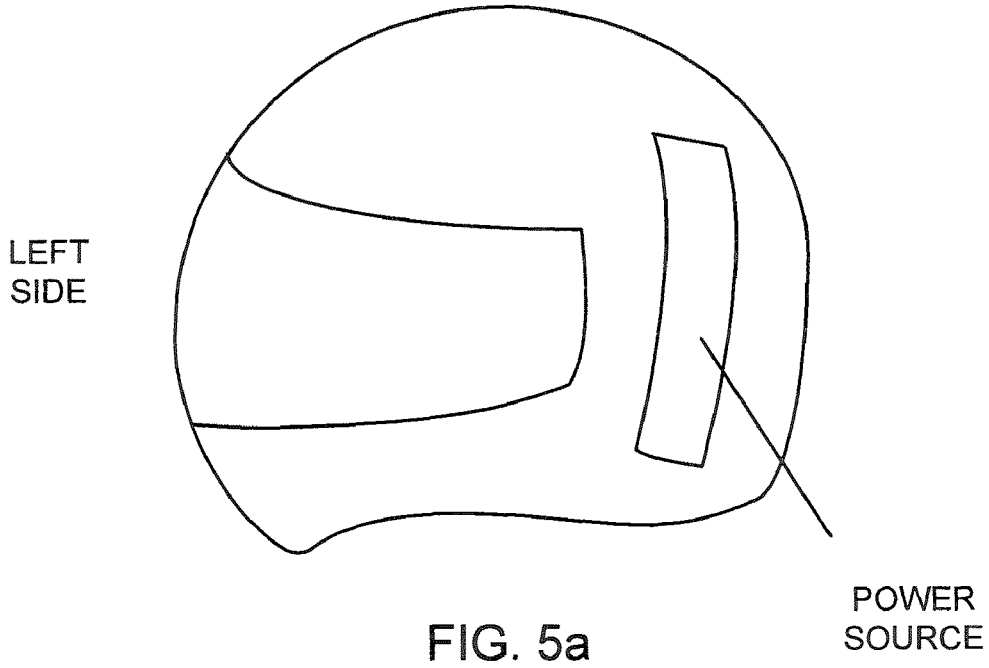
FIG. 5*a* is a perspective view of a helmet of the invention with a power source located on one side of the helmet's shell.
Figure 5B:
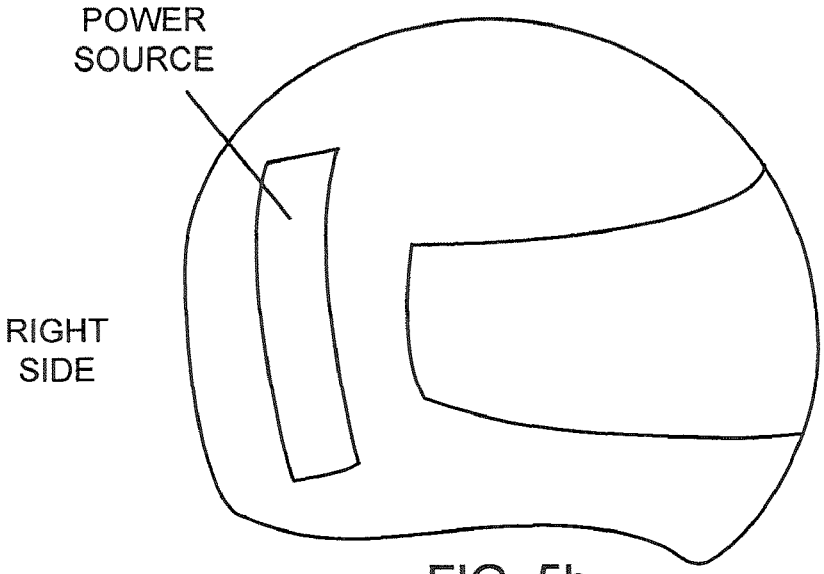
FIG. 5*b* is a substantially opposite side view of the helmet of FIG. 5*a;*

In another embodiment, the power source may be coupled with a top arch of the shell, either on the inside of the shell or on the outside of the shell. An example of this sort of embodiment is shown in FIG. 4*a* and FIG. 4*b*. In yet another embodiment, the power source may be coupled with a side of the shell. In some of these embodiments, the power source may include a first component power source and a second component power source, with each component power source being coupled with different sides of the shell. An example of this sort of embodiment is shown in FIG. 5*a* and FIG. 5*b*.

Figure 6:
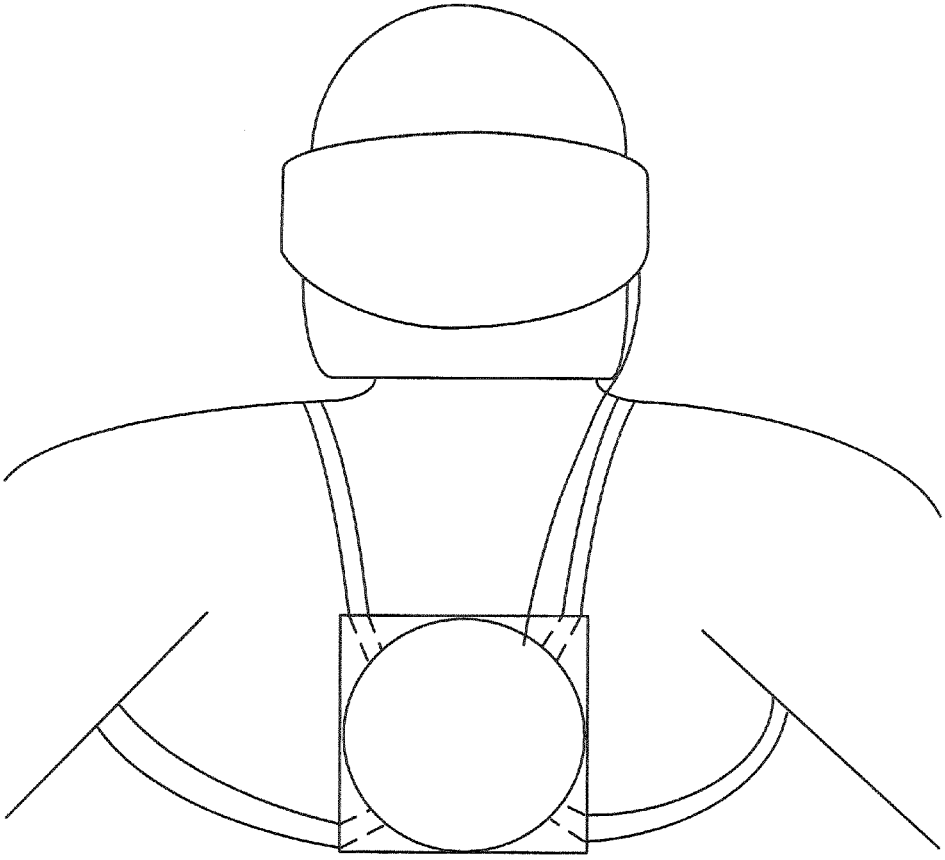
FIG. 6 is a front view of a helmet of the invention with a power source supported by straps around a user of the helmet.
Figure 7:
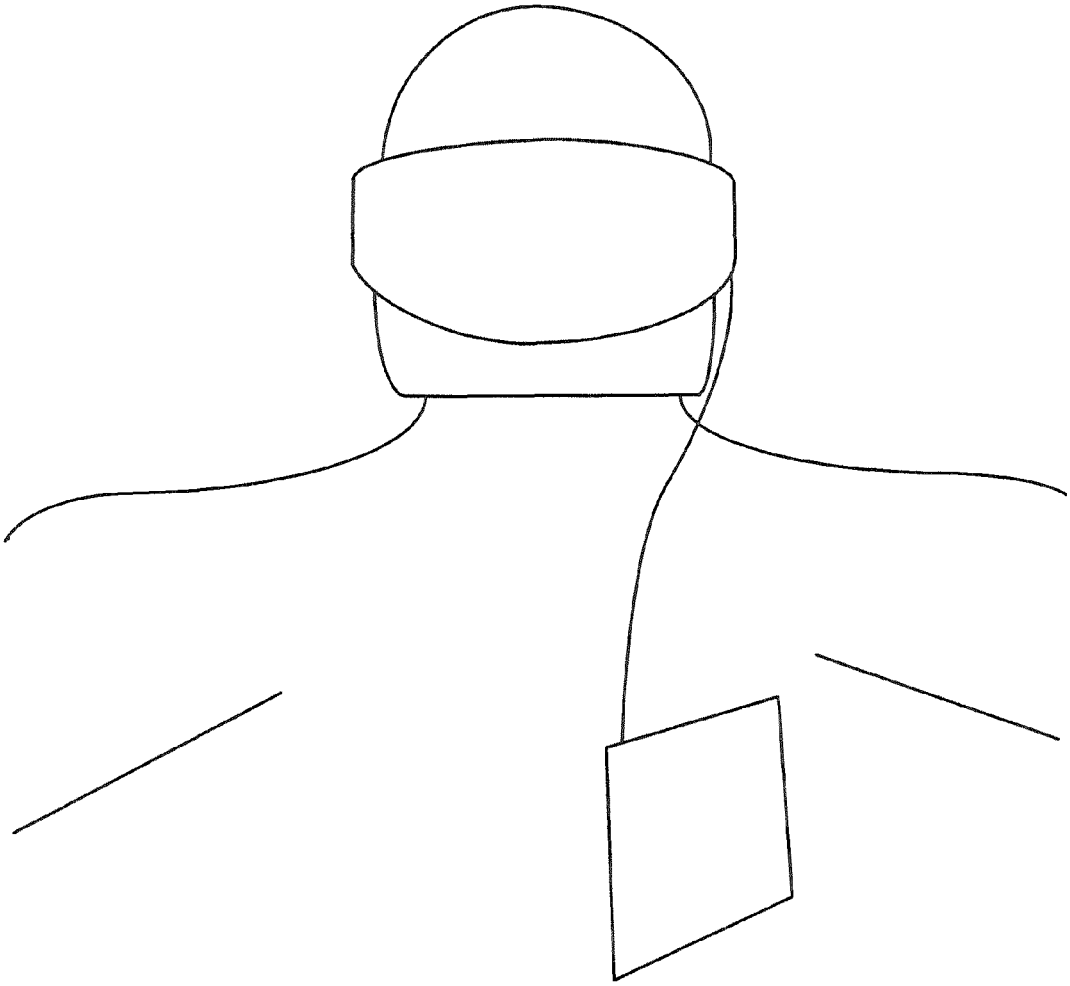
FIG. 7 is a front view of a helmet of the invention with a power source held in a pocket of a user of the helmet.

In embodiments where the power source is supported by the user, various configurations are possible. In some embodiments, the power source may be attached by straps or other fastening mechanisms to the user, possibly as shown in FIG. 6. In other embodiments, the power source may be integrated with clothing of the operator, for example jackets and/or coats. In yet other embodiments, the power source may be carried by the user in a pocket and/or other clothing storage compartments, possibly as shown in FIG. 7. A conductive cable may then be employed to couple the power source with the helmet. In all of the embodiments discussed herein, the user is able to move independently with the helmet without a power connection to a fixed or otherwise less mobile source.

In some embodiments of the invention, various accessories may also be integrated with the shell and/or detachably coupled with the shell. Any of these accessories may also be powered by the power source. In embodiments where the accessories have displays, the display may be integrated into the helmet such that the display is shown via a heads up display on the interior of the visor. In embodiments where the accessories have audio outputs, the earphones or other audio output devices may be integrated with the shell in the proper positions relative to the ear or ears of users of the helmet.

In some embodiments, audio devices, for example MP3 players, may be integrated and/or coupleable with the shell for use by the user. Merely by way of example, the shell may have a coupling point for directly coupling an MP3 player, such as an Apple® iPod®, with the shell. In other embodiments, the shell may have a coupling point for coupling via cable an MP3 player with the shell.

In some embodiments, a beacon, possibly for locating the helmet's user, may be coupled with the shell. Likewise, in some embodiments, a Global Position System ("GPS") receiver, may be coupled with the shell. These devices may be used actively by the user of the helmet, or may be activated and/or communicated with remotely.

In some embodiments, radio and/or satellite communications devices may be coupled with the shell. Microphones, earphones, speakers or other audio input/output devices may be integrated with the shell in the proper positions relative to the mouth of users of the helmet.

In some embodiments, a heating element may be coupled with the shell to warm the interior of the helmet for the comfort of the user. Control inputs on the helmet, for example a rheostat dial or digital control, may allow the user to control the level of warmth produced by the heating element.

In some embodiments, the helmet may also include a short-range inter-device communication device. The short-range inter-device communication device may allow the helmet to communicate with other devices within short ranges. Merely by way of example, while in some embodiments, controls for the defogger element and/or any other accessory on the helmet may be located on the helmet, in embodiments with short-range inter-device communication devices, the controls may be located on a device related to the helmet and/or the user of the helmet. In yet other embodiments, controls for the helmet may be located on both the helmet itself, as well as the other device via the short-range inter-device communication device. Merely by way of example, such related devices could include snowboards, skis, other exercise/sporting/recreational devices, motorcycles, automobiles, snowmobiles, watercraft and/or industrial equipment.

In some embodiments, the short-range inter-device communication device may include one or more of a Near Field Communication ("NFC") device, a IEEE 802.11 device, and a Bluetooth device. These or other short-range inter-device communication devices may allow for control activation and/or deactivation of the defogging element and/or activation and/or deactivation of other accessories on the helmet such as those discussed above via actual control interfaces located on the related exemplary devices discussed above.

The invention has now been described in detail for the purposes of clarity and understanding. However, it will be appreciated that certain changes and modifications may be practiced within the scope of the appended claims.

What is claimed is:

1. A helmet with a defogging visor, wherein the helmet comprises:
- a shell, wherein the shell defines at least a first opening;
- a visor, wherein:
  - the visor is coupled with the shell; and
  - the visor is at least partially disposed over the first opening;
- a defogging element, wherein the defogging element is configured to defog the visor; and
- a power source, wherein:
  - the power source is directly coupled with the shell;
  - the power source is operably coupled with the defogging element; and
  - the power source comprises a first component power source and a second component power source, and the power source being coupled with the shell comprises:
    - the first component power source being coupled with a first side of the shell; and
    - the second component power source being coupled with a second side of the shell, wherein the second side of the shell is substantially opposite the first side of the shell.

2. The helmet with a defogging visor of claim 1, wherein the shell comprises a selection from a group consisting of:
- a one-quarter coverage helmet;
- a one-half coverage helmet;
- a three-quarters coverage helmet; and
- a full coverage helmet.

3. The helmet with a defogging visor of claim 1, wherein the visor is rotatably coupled with the shell.

4. The helmet with a defogging visor of claim 1, wherein the defogging element comprises a heating element.

5. The helmet with a defogging visor of claim 1, wherein the defogging element comprises a micro-convection device.

6. The helmet with a defogging visor of claim 1, wherein the power source being coupled with the shell comprises the power source being permanently coupled with the shell.

7. The helmet with a defogging visor of claim 1, wherein the power source being coupled with the shell comprises the power source being detachably coupled with the shell.

8. The helmet with a defogging visor of claim 1, wherein the power source comprises a rechargeable battery.

9. The helmet with a defogging visor of claim 1, wherein the power source comprises a solar power device.

10. The helmet with a defogging visor of claim 1, wherein the power source comprises a kinetic energy harnessing device.

11. The helmet with a defogging visor of claim 1, wherein the helmet further comprises a coupling point, wherein the coupling point is configured to detachably and operably couple a recharging device with the power source.

12. The helmet with a defogging visor of claim 1, wherein the power source being coupled with the shell comprises the power source being coupled with a side of the shell.

13. The helmet with a defogging visor of claim 1, wherein the helmet further comprises a beacon coupled with the shell.

14. The helmet with a defogging visor of claim 1, wherein the helmet further comprises one or more speakers or earphones.

15. The helmet with a defogging visor of claim 1, wherein the helmet further comprises a radio communications device.

16. The helmet with a defogging visor of claim 1, wherein the helmet further comprises a satellite communications device.

17. The helmet with a defogging visor of claim 1, wherein the helmet further comprises a Global Positioning System ("GPS") receiver.

18. The helmet with a defogging visor of claim 1, wherein the helmet further comprises a heating element to warm the interior of the helmet.

19. The helmet with a defogging visor of claim 1, wherein the helmet further comprises a short-range inter-device communication device.

20. The helmet with a defogging visor of claim 19, wherein the short-range inter-device communication device comprises a selection from a group consisting of:

a Near Field Communication ("NFC") device;

a IEEE 802.11 device; and a Bluetooth device.

21. The helmet with a defogging visor of claim 19, wherein the short-range inter-device communication device is configured to facilitate short-range remote activation and deactivation of the defogging element.

22. The helmet with a defogging visor of claim 19, wherein the short-range inter-device communication device is configured to facilitate short-range remote activation and deactivation of an accessory device of the helmet.

23. The helmet with a defogging visor of claim 1, wherein the helmet further comprises a power switch to control the defogging element.

* * * * *